US008936179B2

(12) United States Patent
Hsu et al.

(10) Patent No.: US 8,936,179 B2
(45) Date of Patent: Jan. 20, 2015

(54) ANTI-LEAKAGE LIQUID SOAP VALVE STRUCTURE

(71) Applicant: Hokwang Industries Co., Ltd., New Taipei (TW)

(72) Inventors: Chi-Chin Hsu, New Taipei (TW); Kuo-Chou Lee, Keelung (TW); Tsan-Chang Huang, Taipei (TW)

(73) Assignee: Hokwang Industries Co., Ltd., New Taipei (TW)

( * ) Notice: Subject to any disclaimer, the term of this patent is extended or adjusted under 35 U.S.C. 154(b) by 60 days.

(21) Appl. No.: 13/645,384

(22) Filed: Oct. 4, 2012

(65) Prior Publication Data

US 2014/0097204 A1 Apr. 10, 2014

(51) Int. Cl.
*B67D 7/76* (2010.01)
*B67D 7/06* (2010.01)
*B67D 3/00* (2006.01)

(52) U.S. Cl.
USPC ..... 222/190; 222/181.1; 222/504

(58) Field of Classification Search
USPC ..... 222/52, 63, 181.1, 181.3, 190, 333, 222/504, 639, 642, 207, 108, 145.5
See application file for complete search history.

(56) References Cited

U.S. PATENT DOCUMENTS

2005/0284887 A1* 12/2005 Lewis et al. ..... 222/181.3
2007/0051748 A1* 3/2007 Yates et al. ..... 222/135
2011/0017778 A1* 1/2011 Kadiks et al. ..... 222/190

FOREIGN PATENT DOCUMENTS

TW 579820 3/2004

* cited by examiner

*Primary Examiner* — Kevin P Shaver
*Assistant Examiner* — Stephanie E Williams
(74) *Attorney, Agent, or Firm* — Muncy, Geissler, Olds & Lowe, P.C.

(57) ABSTRACT

An anti-leakage liquid soap valve structure includes a liquid soap conduit, an air conduit and a foam discharging tube. The liquid soap conduit includes a soap entering tube for receiving liquid soap, a soap discharging tube communicating with the soap entering tube and having a liquid soap chamber, a liquid soap exit, and a soap discharging valve. The soap discharging valve includes an elastic washer disposed at the liquid soap exit, and a pressing member to press against the elastic washer. The air conduit includes an outer housing forming an air chamber with the liquid soap conduit, an air exit located at one side of the air chamber, and an air supply valve linking with the soap discharging tube. The foam discharging tube includes a gas-liquid mixing chamber located at the liquid soap exit and the air exit, and a foam exit communicating with the gas-liquid mixing chamber.

13 Claims, 7 Drawing Sheets

ANTI-LEAKAGE LIQUID SOAP VALVE STRUCTURE

FIELD OF THE INVENTION

The present invention relates to a liquid soap structure, and particularly to a liquid soap valve structure for preventing liquid soap leakage.

BACKGROUND OF THE INVENTION

A soap supplying device is categorized into a manual soap discharge type and an automatic soap discharge type. A manual soap supplying device usually includes a soap conduit. The soap conduit communicates with a liquid soap container as well as a pressure device having a liquid soap pipe. The liquid soap pipe includes a pressure receiving section having a liquid soap chamber, a pressure applying section movable relative to the pressure receiving section and to apply pressure to the pressure receiving section, and check valves respectively disposed at two ends of the liquid soap pipe. The soap supplying device further includes a press section for a user to press thereupon to further operate the pressure receiving section. By butting the liquid soap chamber in the pressure receiving section through the pressure applying section, liquid soap in the liquid soap chamber is delivered and discharged to a hand of the user along the liquid soap pipe. An automatic soap supplying device of the prior art usually incorporates the above manual soap supplying device, which cooperates with an additional motor-driven automatic press device. As the automatic press device operates at the press section or the pressure applying section, pressure is automatically applied on the pressure receiving section by the pressure applying section to achieve liquid soap supply. Further, to adapt to a wall-mounted soap supplying device and habits of hand operations of users, a soap supplying device having a soap discharge opening facing downwards is developed.

A check valve device corresponding to a soap discharge opening is usually made of a plastic valve disposed at the soap discharge opening. By use of an elastic member, the plastic valve presses tightly against an inner wall of the soap discharge opening. When a press initiated by a user or when an automatic press device is applied, the plastic valve disengages from the inner wall to allow the liquid soap to pass through the liquid soap pipe to reach the soap discharge opening. Although the above structure is suitable for a soap supplying device that discharges the soap in an upward direction, complications are however incurred when implementing the above structure to a soap supplying device that discharges the soap in a downward direction. First of all, the liquid soap in an inverted-style liquid soap container applies a pressure to push the plastic valve due to gravitational force. In order to prevent the liquid soap from leaking through a gap between the plastic valve and the inner wall to drip onto the ground, the strength of the elastic member needs to be reinforced to render even greater tightness between the plastic valve and the inner wall. However, the increased strength of the elastic valve at the same time raises the level of force that needs to be applied for operating the pressure applying section. For example, a motor of a battery-driven automatic soap supplying device may not function properly due to insufficient power from the battery, such that the press section or the pressure applying section is not successfully propelled. Further, in a plug-in automatic soap supplying device that is free of the above issue of insufficient power from the battery, since the plastic valve is in prolonged and constant friction with the soap discharge opening, contact planes of the plastic valve and the soap discharge opening can easily become worn out. Thus, a gap between the contact planes of the plastic valve and the soap discharge opening is formed such that the liquid soap is guided through the gap to drip via the soap discharge opening.

The Taiwan Patent No. 579820 discloses a soap supplying device as described above. The soap supplying device includes a liquid soap pipe. The liquid soap pipe respectively has a liquid soap entrance and a liquid soap exit at two ends thereof. Further, the liquid soap pipe includes a roller valve at one end corresponding to the liquid soap entrance, and a plastic valve at one end corresponding to the liquid soap exit. The plastic valve is pushed by an elastic member to butt against an inner wall around the liquid soap exit on the liquid soap pipe. In this prior art, the above issue of the leaked liquid soap dripping to the ground due to inadequate tightness between the plastic valve and the inner wall of the liquid soap exit caused by the insufficiently powered motor or the wear of the plastic valve and the inner wall is likely generated.

SUMMARY OF THE INVENTION

Therefore the primary object of the present invention is to provide a power-saving liquid soap valve for effectively eliminating liquid soap leakage.

To achieve the above object, an anti-leakage liquid soap valve structure applied to a liquid soap container is provided by the present invention. The liquid soap container includes an accommodating section for accommodating liquid soap, and a liquid soap entrance communicating with the accommodating section and facing downwards. The anti-leakage liquid soap valve structure includes a liquid soap conduit, an air conduit and a foam discharging tube. The liquid soap conduit includes a soap entering tube communicating with the liquid soap entrance to receive the liquid soap, a soap discharging tube communicating with the soap entering tube and having a liquid soap chamber to allow the soap entering tube to push forwards, and a liquid soap exit located at one end of the soap discharging tube relative to the liquid soap entrance, and a soap discharging valve. The soap discharging valve includes an elastic washer disposed at the liquid soap exit, and a pressing member to press against an inner junction plane of the elastic washer corresponding to the liquid soap entrance. The air conduit includes an outer housing encircling the liquid soap conduit to form an air chamber therewith, an air exit located at one side of the air chamber, and an air supply valve linking with the soap discharging tube and discharging air from the air chamber to the air exit. The air supply valve includes at least one air supply channel for delivering the air from the air chamber to another side of the air chamber. The foam discharging tube includes a gas-liquid mixing chamber located at the liquid soap exit and the air exit, and a foam exit communicating with the gas-liquid mixing chamber.

Further, the elastic washer includes a through hole. The pressing member includes an axle strut penetrating into the through hole, and a tightening end connected to the axle strut to press against an inner junction plane of the elastic washer corresponding to the liquid soap entrance.

Further, the tightening end includes at least two butting members butting against one side of the elastic washer corresponding to the liquid soap entrance, and at least one spacing region formed between the two butting members.

Further, the elastic washer is made of a rubber material.

Further, the soap discharging valve includes a limiting end located at one end of the axle strut relative to the tightening end.

Further, the air supply valve includes a supporting plate linking with the soap discharging tube and having the air supply channel, and an elastic valve disposed on the supporting plate. The elastic valve includes an outer ring pressing against a wall of the outer housing corresponding to the air chamber, and an elastic section covering the air supply channel.

Further, the elastic valve is made of a rubber material.

Further, the liquid soap conduit includes an elastic member encircling the soap entering tube and the soap discharging tube.

Further, the liquid soap conduit includes a check valve disposed at the liquid soap entrance.

Further, the check valve includes a soap entering opening communicating with the liquid soap entrance and the soap entering tube, a stopping member formed at an outer diameter greater than an inner diameter of the soap entering opening, and at least one protruding section disposed in the soap entering opening to support the stopping member.

Further, the stopping member is made of a rubber material.

Further, the elastic washer includes a deformation region surrounding the through hole.

Further, the foam discharging tube includes a press section, and a pressure applying section linking with the press section to push the air supply valve.

Further, the foam discharging tube includes a foaming filter disposed at the foam exit.

Therefore, through the deformation between the elastic washer and the pressing member of the soap discharging valve, the liquid soap exit can be controlled to open or close. Thus, with only a small force applied to the automatic press device, the liquid soap chamber is pressurized to cause deformation of the elastic washer so that a passage allowing the liquid soap to pass through is generated. Further, as the elastic washer is made of a rubber material, the liquid soap is more effectively prevented from leaking along the wall of the liquid soap exit. Moreover, the air supply valve of the present invention allows the soap discharging tube to restore to its initial position when being pressed by the elastic member. Meanwhile, through the negative pressure in the air chamber, the residual liquid soap at the foam exit and the gas-liquid mixing chamber is sucked back to the air chamber via the air supply channel, thereby preventing the residual liquid soap from dripping to the ground and maintaining tidiness of an operation environment.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
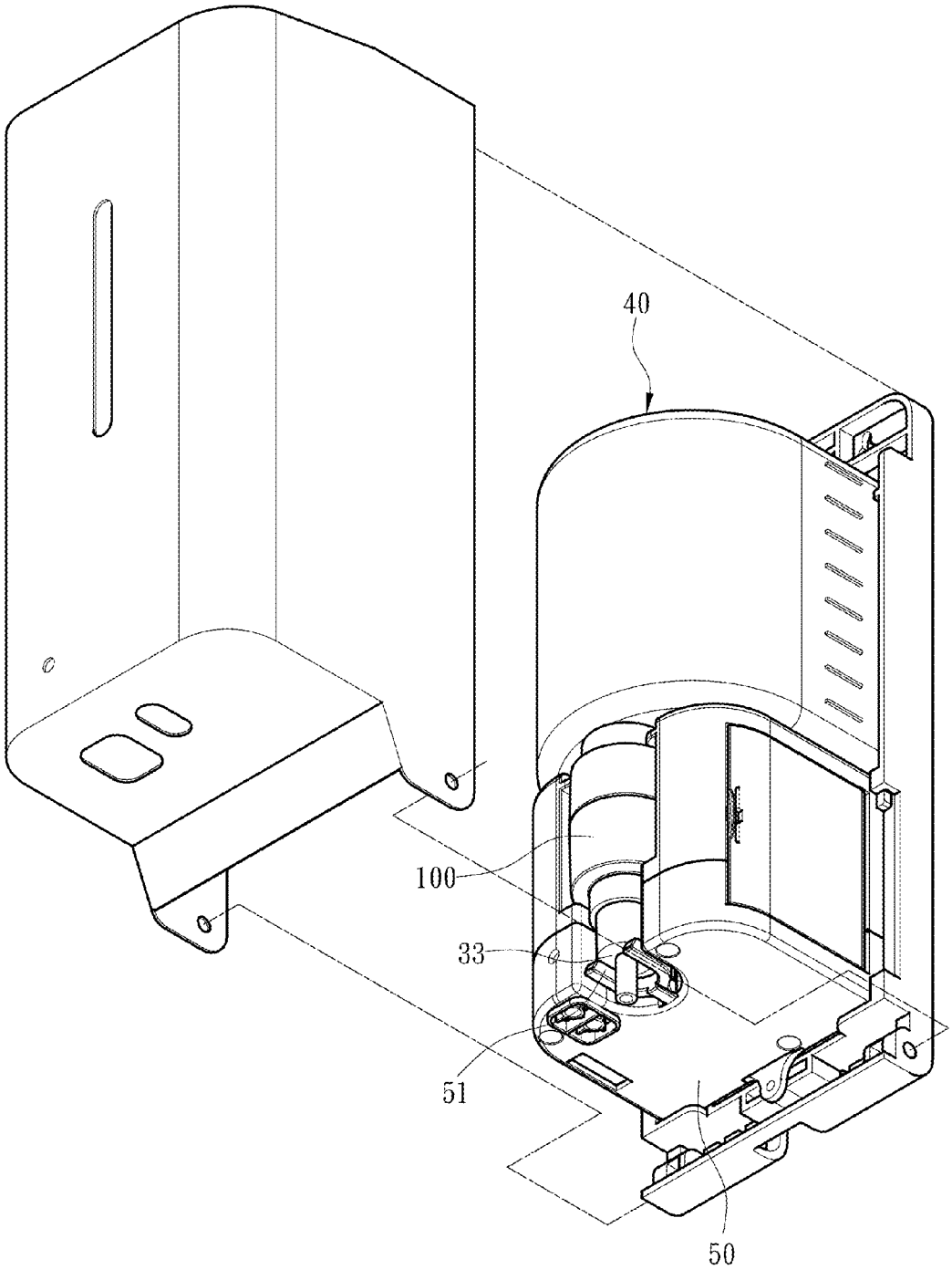
FIG. 1 is a schematic diagram according to an embodiment of the present invention cooperating with an automatic soap supplying device.

FIG. 1 is a schematic diagram of an anti-leakage liquid soap valve structure according to an embodiment of the present invention cooperating with an automatic soap supplying device. Referring to FIG. 1, an anti-leakage liquid soap valve structure 100 according to an embodiment of the present invention is applied in cooperation with a wall-mounted automatic soap supplying device. The wall-mounted automatic soap supplying device includes a liquid soap container 40 and an automatic press device 50. The automatic press device 50 is disposed below the liquid soap container 40 and is powered by electricity. The liquid soap container 40 includes an accommodating section 41 for accommodating liquid soap 42, and a liquid soap entrance 43 communicating with the accommodating section 41 and facing downwards. At a position corresponding to the liquid soap entrance 43, the automatic press device 50 includes a holding region to hold the anti-leakage liquid soap valve structure 100 of the present invention. The automatic press device 50 further includes a holding region formed correspondingly to the liquid soap entrance 43 to hold the anti-leakage liquid soap valve structure 100 and a butting element 51 that is controlled by a driving motor (not shown) to swing up and down. A press section 33 is located at one end of the anti-leakage liquid soap valve structure 100 to engage with the butting element 51, thereby forming the automatic soap supplying device with an exit facing downwards.

Figure 2:
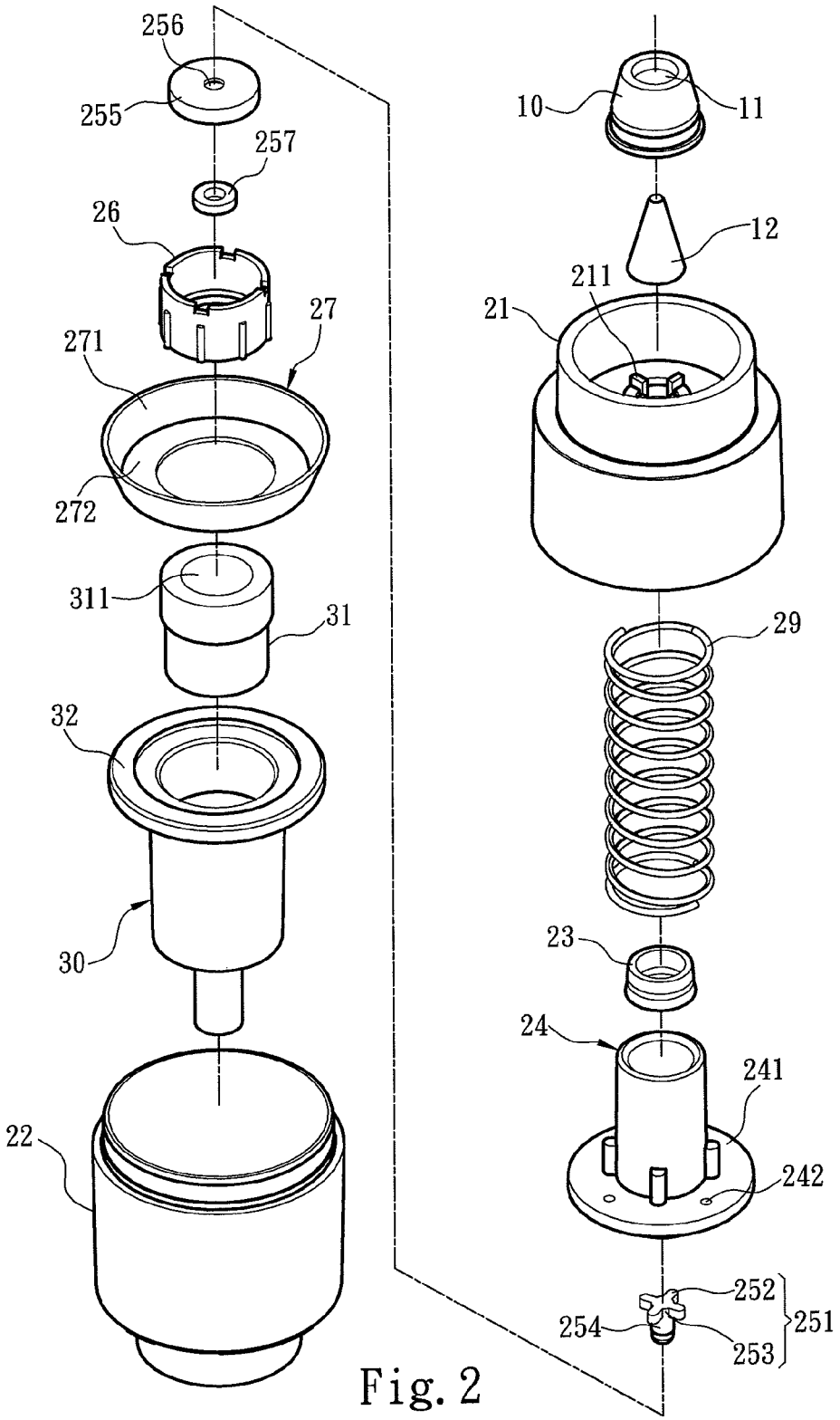
FIG. 2 and FIG. 3 are exploded views of an anti-leakage liquid soap valve structure according to the present invention.
Figure 3:
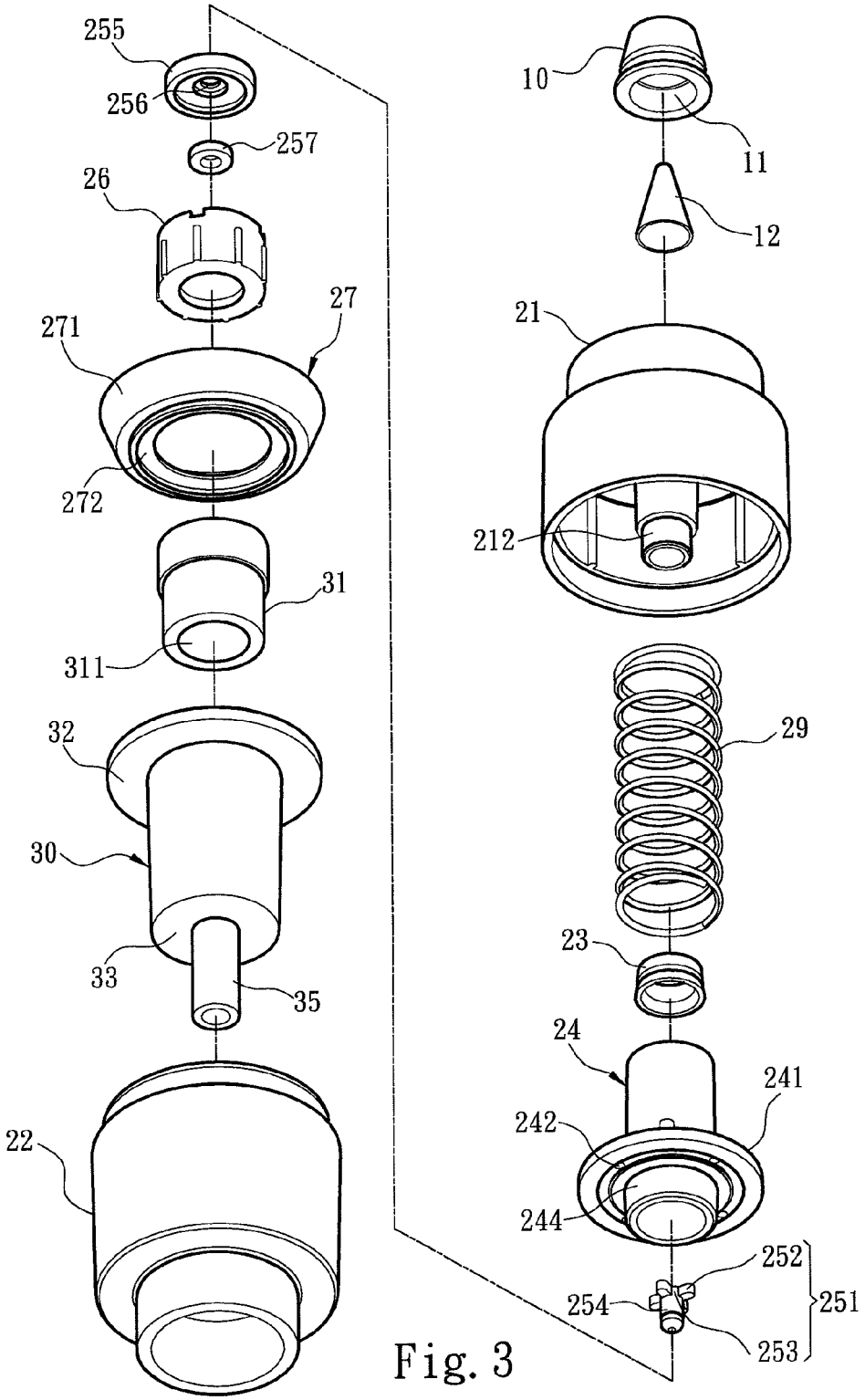
Figure 4A:
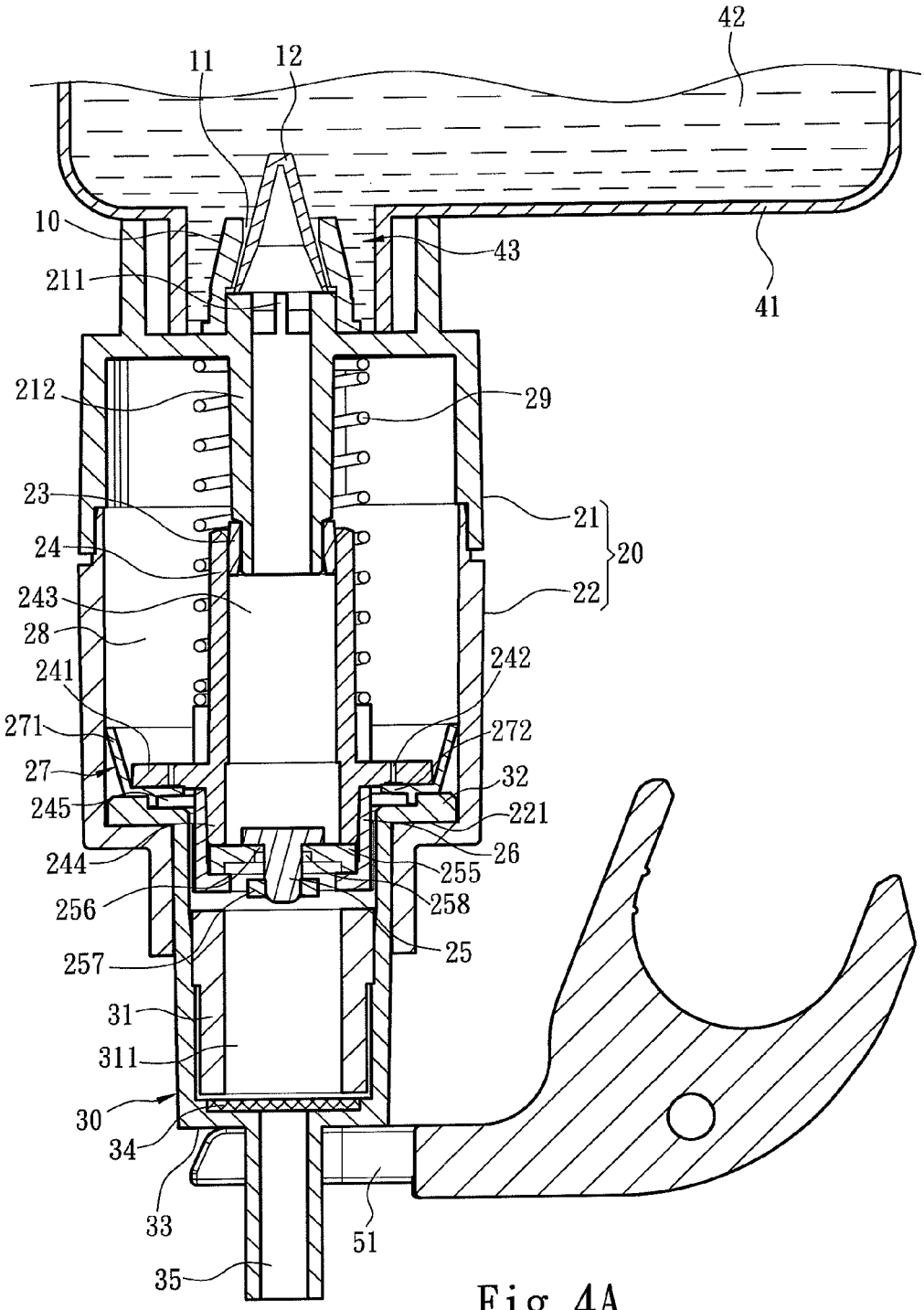
FIGS. 4A to 4C are schematic diagrams of gas-liquid mixture in anti-leakage liquid soap valve structure according to the present invention.

FIGS. 2 and 3 show exploded views of an anti-leakage liquid soap valve structure of the present invention; FIG. 4A shows a schematic diagram of gas-liquid mixture in an anti-leakage liquid soap valve structure of the present invention. Referring to FIGS. 2, 3 and 4A, an anti-leakage liquid soap valve structure 100 of the present invention includes a liquid soap conduit for accommodating the liquid soap 42 in the liquid soap container 40 and discharging the liquid soap 42 by pressure, an air conduit for accommodating air and discharging the air by pressure, and a foam discharging tube 30 for receiving and mixing the liquid soap 42 of the liquid soap conduit and the air of the air conduit to produce a foamed liquid soap. The liquid soap conduit includes a soap entering tube 212 communicating with the liquid soap entrance 43 to receive the liquid soap 42, a soap discharging tube 24 communicating with the soap entering tube 212 and having a liquid soap chamber 243 to allow the soap entering tube 212 to push forwards, a liquid soap exit 244 located at one end of the soap discharging tube 24 relative to the liquid soap entrance 43, a soap discharging valve 25, and a positioning member 26 located at the liquid soap exit 244 to clamp the soap discharging valve 25 with the liquid soap exit 244 from two sides. The soap discharging valve 25 includes an elastic washer 255 disposed at the liquid soap exit 244, and a pressing member pressing against an inner junction plane of the elastic washer 255 corresponding to the liquid soap entrance 43. The air conduit includes an outer housing 20 encircling the liquid soap conduit to form an air chamber 28 therewith, an air exit located at one side of the air chamber 28, and an air supply valve linking with the soap discharging tube 24 and discharging the air from the air chamber 28 to the air exit 245. The outer housing 20 is formed by an upper half 21 and a lower half 22. The air supply valve includes at least one air supply channel 242 for discharging the air in the air chamber 28 towards the other side of the air chamber 28. The foam discharging tube 30 includes a gas-liquid mixing chamber 311 located at the liquid soap exit 244 and the air exit 245 and formed by an encircling soap chamber wall 31, a foam exit 35 communicating with the gas-liquid mixing chamber 311, and a foaming filter 34 disposed at the foam exit 35. To allow the air supply valve to move within the air chamber 28, and to drive the soap discharging tube 24 to move relative to the soap entering tube 212 by the air supply valve, the foam discharging tube 30 includes a pressure applying section 32 linking with the press section 33 to push the air supply valve. To confine the pressure applying section 32 within the outer housing 20, the outer housing 20 includes a limiting section 221 that butts the pressure applying section 32 to limit the pressure applying section 32 within the outer housing 20. Further, to enable the air supply valve and the soap discharging tube 24 to restore to their initial positions, the liquid soap conduit includes an elastic member 29 encircling the soap entering tube 212 and the soap discharging tube 24. The elastic member 29 has two ends butting against the inner wall of the air chamber 28 and connecting to the soap discharging tube 24. By storing the force applied to the pressure applying section 32, elasticity for restoring the soap discharging tube 24 and the air supply valve back to their initial positions is provided.

The elastic washer 255 has a through hole 256. The pressing member includes an axle strut 254 penetrating through the through hole 256, a tightening end 251 connected to the axle strut 254 to press against an inner junction plane of the elastic washer 255 corresponding to the liquid soap entrance 43, and a limiting end 257 located at the axle strut 254 relative to the tightening end 251. The elastic washer 255 includes a deformation region 258 surrounding the through hole 256 to promote deformation of the elastic washer 255. The tightening end 251 includes at least two butting members 252 butting against one side of the elastic washer 255 corresponding to the liquid soap entrance 43, and at least one spacing region 253 formed between the two butting members 252. With the above configuration, the soap discharging valve 25 of the liquid soap conduit forms an exit for allowing the liquid soap 42 to pass through the deformation thereof. Thus, when pressure is applied by the soap entering tube 212 to the liquid soap chamber 243 of the soap discharging tube 24, the pressing member of the soap discharging valve 25 is pressed to move downwards, and further presses the through hole 256 to deform and expand until the elastic washer 255 contacts the limiting end 257. At this time, the spacing region 253 between the two butting members 252 communicates with the expanded through hole 256 to form a passage for the liquid soap 42 to pass through. To steadily fit the elastic washer 255 around the axle strut 254, the elastic washer 255 is preferably made of a rubber material. As the rubber material expands when being humidified, the elastic washer 255 is able to more steadily fit around the axle strut 254 to prevent the liquid soap 42 from leaking via the through hole 256.

Moreover, to prevent the liquid soap 42 from reflowing into the liquid soap container 40 via the liquid soap entrance 43 when pressure is applied to the soap discharging tube 24 by the soap entering tube 212, the liquid soap conduit further includes a check valve 10 disposed at the liquid soap entrance 43. The check valve 10 includes a soap entering opening 11 communicating with the liquid soap entrance 43 and the soap entering tube 212, a stopping member 12 formed at an outer diameter greater than an inner diameter of the soap entering opening 11, and at least one protruding section 211 disposed in the soap entering opening 11 to support the stopping member 12. The stopping member 12 is preferably made of a rubber material. An airtight ring 23 is disposed between the soap entering tube 212 and the soap discharging tube 24 to separate the liquid soap chamber 243 and the air chamber 28. When pressure is applied by the soap entering tube 212 to the soap discharging tube 24, the liquid soap 42 in the liquid soap chamber 243 flows towards the liquid soap entrance 43 and the liquid soap exit 244. At this time, the check valve 10 disposed at the liquid soap entrance 43 moves towards the liquid soap entrance 43 due to the pressure in the liquid soap chamber 243. Since the outer diameter of the stopping member 12 is greater than the inner diameter of the soap entering opening 11, the stopping member 12 blocks on the soap entering opening 11 to allow the liquid soap 42 to flow towards the liquid soap exit 244.

To facilitate delivery of the air from the air chamber 28 to the air exit 245, the air supply valve includes a supporting plate 241 and an elastic valve 27. The supporting plate 241 is linked with the soap discharging tube 24, and includes the air supply channel 242. The elastic valve 27 includes an outer ring 271 pressing against a wall of the outer housing 20 corresponding to the air chamber 28, and an elastic section 272 covering the air supply channel 242. When the supporting plate 241 is pressed to move towards an upper end of the air chamber 28, the outer ring 271 presses tightly against the wall of the air chamber 28, such that the air pushes the elastic section 272 covering the air supply channel 242 through the air supply channel 242. The elastic valve 27 is preferably made of a rubber material for not only tightly pressing against the wall of the air chamber 28 but also avoiding a wearing issue of hard materials.

Figure 4B:
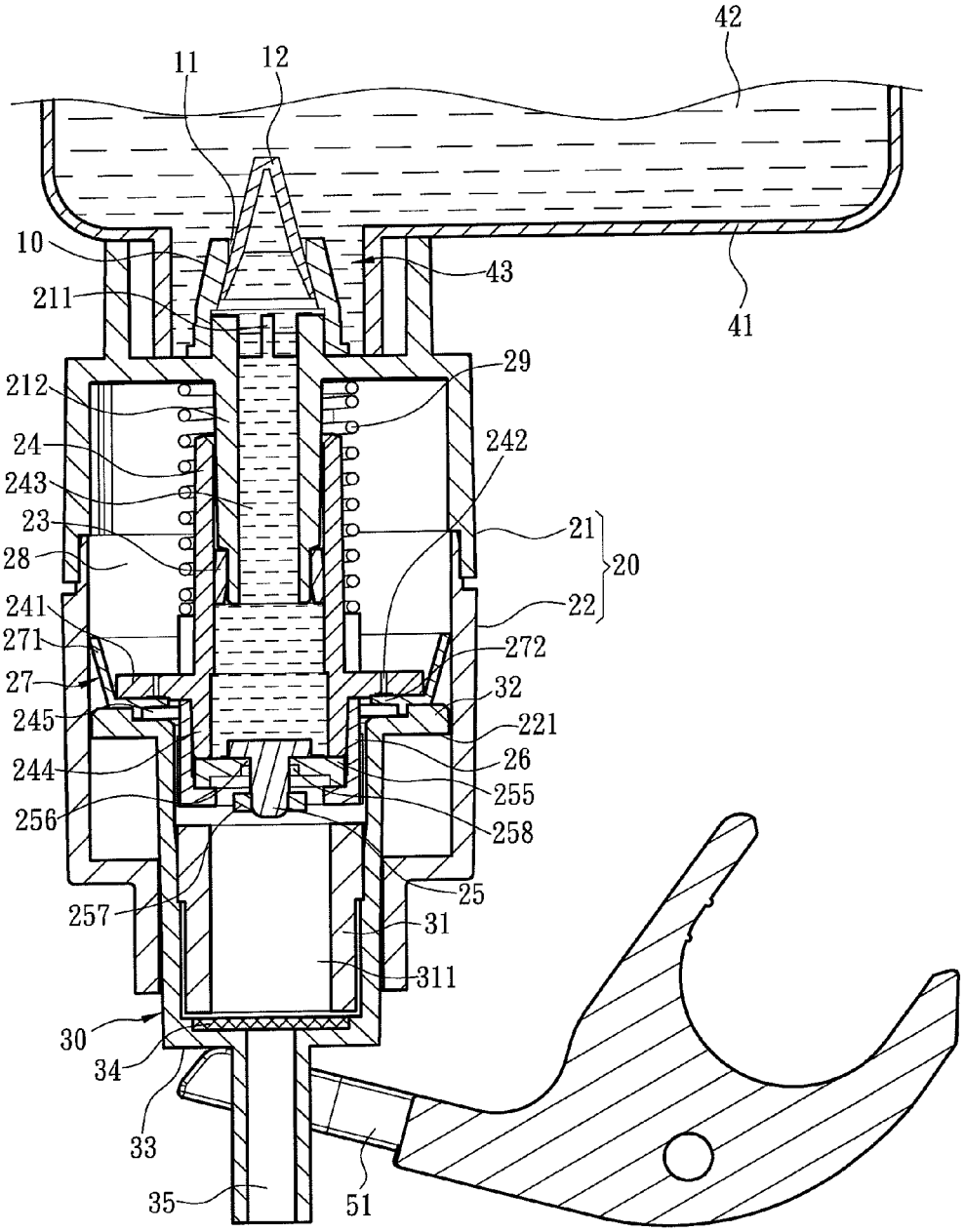
Figure 4C:
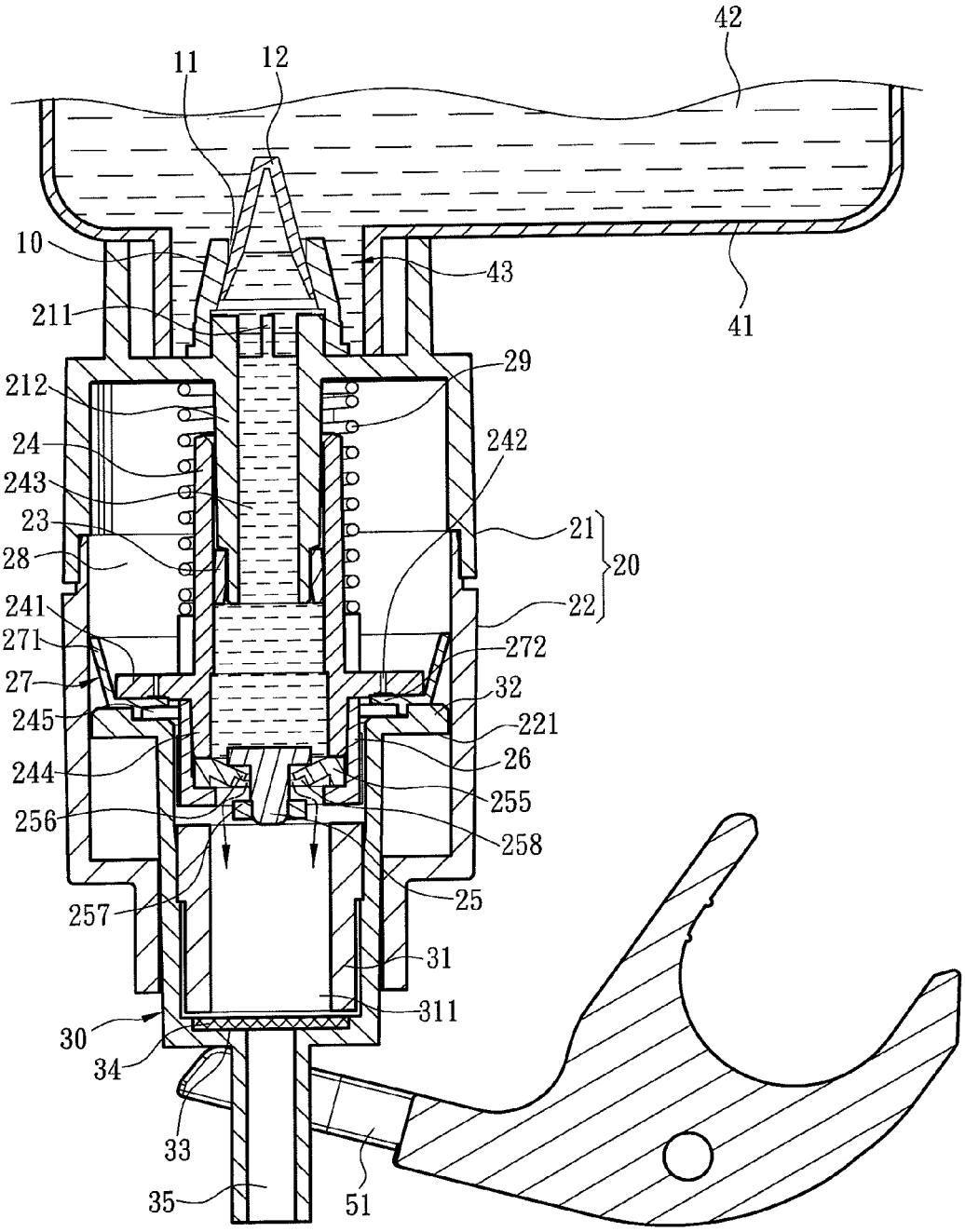

FIGS. 4A to 4C are schematic diagrams of gas-liquid mixture as well as a corresponding gas-liquid mixing path in an anti-leakage liquid soap valve structure of the present invention. Referring to FIG. 4A, at an initial state, the pressure applying section 32 butts against the limiting section 221 of the outer housing 20, and the air supply valve and the soap discharging tube 24 linked with the pressure applying section 32 stay at the initial positions. At this time, the elastic member 29 is dilated, and a check valve at one end of the liquid soap entrance 43 is rested on and supported by the protruding section 211. At least one gap is formed between the check valve and the protruding section 211, so that the liquid soap 42 passes through the gap to fill the liquid soap chamber 243. The liquid soap chamber 243 currently does not receive any pressure, the through hole 256 of the soap discharging valve 25 is in contact with the surrounding wall of the axle strut 254, and the liquid soap 42 is confined within the liquid soap chamber 243. Referring to FIG. 4B, when the press section 33 receives force from the butting element 51 and moves upwards, the pressure applying section 32 is driven by the press section 33 to move upwards to push the air supply valve and to compress the elastic member 29, such that the elastic member 29 is deformed and stores elasticity. At this time, the soap entering tube 212 exerts pressure to the liquid soap chamber 243 in the soap discharging tube 24. The check valve at one end of the liquid soap entrance 43, as affected by the positive pressure in the liquid soap chamber 243, moves towards the liquid soap entrance 43 and butts on the soap entering opening 11, so that the liquid soap 42 in the liquid soap chamber 243 does not enter the liquid soap container 40. Referring to FIG. 4C, when the liquid soap chamber 243 is pressed, the liquid soap 42 is prohibited from moving towards the liquid soap entrance 43. At this time, the liquid soap 42 can only flow towards the liquid soap exit 244 to exert pressure to the soap discharging valve 25. As the soap discharging valve 25 receives pressure and is affected by the pressing member, it moves downwards to cause deformation of the elastic washer 255, such that the through hole 256 on the elastic washer 255 expands downwards. Thus, a passage is formed between the spacing region 253 between the butting members 252 on the pressing member and the expanded through hole 256 so as to allow the liquid soap 42 to enter the liquid soap exit 244 via the soap discharging valve 25 and further enter the gas-liquid mixing chamber 311 through the liquid soap exit 244. Meanwhile, when the air supply valve moves towards an upper end of the air chamber 28, air is only allowed to pass through the air supply channel 242 on the supporting plate 241 since the outer ring 271 of the elastic valve 27 presses tightly against the wall of the air chamber 28. The air passing through the air supply channel 242 pushes the elastic section 272 covering the air supply channel 242, and is then forwarded towards the air exit 245 to allow the air to enter the gas-liquid mixing chamber 311 to mix with the liquid soap 42. Further, with the foaming filter 34 disposed on the foam exit 35, the liquid soap 42 is thoroughly mixed with the air to form foamed liquid soap which is then sent to a hand of a user via the foam exit 35.

Figure 5:
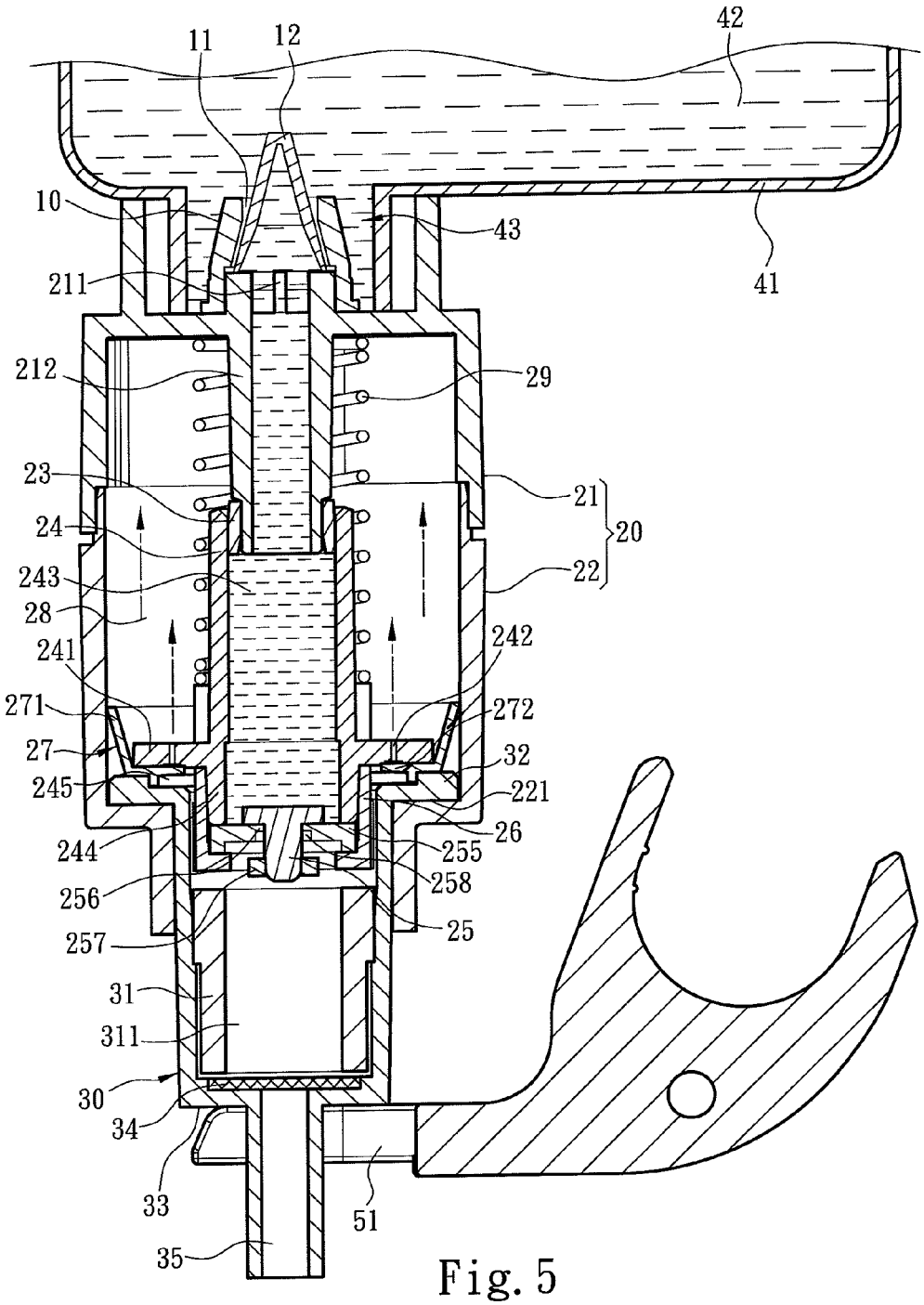
FIG. 5 is a schematic diagram of liquid soap withdrawal in an anti-leakage liquid soap valve structure according to the present invention.

In the present invention, to prevent the residual liquid soap 42 in the gas-liquid mixing chamber 311 from dripping to the ground via the foam exit 35, the anti-leakage liquid soap valve structure 100 of the present invention further provides a back-sucked function of the liquid soap 42. FIG. 5 shows a schematic diagram of withdrawing liquid soap 42 by an anti-leakage liquid soap valve structure according to the present invention. When the soap discharging tube 24 is butted by the elastic member 29 to restore to the initial position, the air supply valve is linked by the soap discharging tube 24 to push the pressure applying section 32 to restore as well until the pressure applying section 32 butts the limiting section 221. At this time, due to the negative pressure in the air chamber 28, air sequentially passes through the foam exit 35, the gas-liquid mixing chamber 311 and the air supply channel 242 to be sucked back to the air chamber 28. Meanwhile, the residual liquid soap 42 at the gas-liquid mixing chamber 311 and the foam exit 35 is sucked back to the air chamber 28 along with the air flow. Further, when inner and outer pressures balance, the elastic section 272 butts on the air supply channel 242 to prohibit a small amount of liquid soap 42 from flowing into the gas-liquid mixing chamber 311.

In conclusion, through the deformation between the elastic washer and the pressing member of the soap discharging valve, the liquid soap exit can be controlled to open or close. Thus, with only a small force applied to the automatic press device, the liquid soap chamber is pressurized to cause deformation of the elastic washer so that a passage allowing the liquid soap to pass through is generated. Further, as the elastic washer is made of a rubber material, the liquid soap is more effectively prevented from leaking along the wall of the liquid soap exit. Moreover, the air supply valve of the present invention allows the soap discharging tube to restore to its initial position when being pressed by the elastic member. Meanwhile, through the negative pressure in the air chamber, the residual liquid soap at the foam exit and the gas-liquid mixing chamber is sucked back to the air chamber via the air supply channel, thereby preventing the residual liquid soap from dripping to the ground and maintaining tidiness of an operation environment.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An anti-leakage liquid soap valve structure, disposed in cooperation with a liquid soap container; the liquid soap container including an accommodating section for accommodating liquid soap, and a liquid soap entrance communicating with the accommodating section and facing downwards; the anti-leakage liquid soap valve structure comprising:

a liquid soap conduit, comprising:

a soap entering tube, communicating with the liquid soap entrance to receive the liquid soap;

a soap discharging tube, communicating with the soap entering tube, including a liquid soap chamber to allow the soap entering tube to push forwards, and a liquid soap exit located at one end of the soap discharging tube relative to the liquid, soap entrance; and a soap discharging valve, including an elastic washer disposed at the liquid soap exit, and a pressing member pressing against an inner junction plane of the elastic washer corresponding to the liquid soap entrance;

an air conduit, comprising:

an outer housing, encircling the liquid soap conduit to form an air chamber therewith;

an air exit, located at one side of the air chamber; and an air supply valve, linking with the soap discharging tube, discharging air from the air chamber to the air exit, including at least one air supply channel to discharge the air from the air chamber to another side of the air chamber; and a foam discharging tube, comprising:

a gas-liquid mixing chamber, located at the liquid soap exit and the air exit; and a foam exit, communicating with the gas-liquid mixing chamber, wherein the air supply valve comprises:

a supporting plate, linking with the soap discharging tube, including the air supply channel; and an elastic valve, disposed on the supporting plate, including an outer ring pressing a wall of the outer housing corresponding to the air chamber, and an elastic section covering the air supply channel.

2. The anti-leakage liquid soap valve structure of claim 1, wherein the elastic washer comprises a through hole; the pressing member comprising an axle strut penetrating through the through hole, and a tightening end connected to the axle strut to press against an inner junction plane of the elastic washer corresponding to the liquid soap entrance.

3. The anti-leakage liquid soap valve structure of claim 2, wherein the tightening end comprises at least two butting members butting against one side of the elastic washer corresponding to the liquid soap entrance, and at least one spacing region formed between the at least two butting members.

4. The anti-leakage liquid soap valve structure of claim 1, wherein the elastic washer is made of a rubber material.

5. The anti-leakage liquid soap valve structure of claim 1, wherein the soap discharging valve comprises a limiting end located at one end of the axle strut corresponding to the tightening end.

6. The anti-leakage liquid soap valve structure of claim 1, wherein the elastic washer comprises a deformation region surrounding the through hole.

7. The anti-leakage liquid soap valve structure of claim 1, wherein the elastic valve is made of a rubber material.

8. The anti-leakage liquid soap valve structure of claim 1, wherein the liquid soap conduit comprises an elastic member encircling the soap entering tube and the soap discharging tube.

9. The anti-leakage liquid soap valve structure of claim 1, wherein the liquid soap conduit comprises a check valve disposed at the liquid soap entrance.

10. The anti-leakage liquid soap valve structure of claim 9, wherein the check valve comprises a soap entering opening communicating with the liquid soap entrance and the soap entering tube, a stopping member formed at an outer diameter greater than an inner diameter of the soap entering opening, and at least one protruding section disposed in the soap entering opening to support the stopping member.

11. The anti-leakage liquid soap valve structure of claim 10, wherein the stopping member is made of a rubber material.

12. The anti-leakage liquid soap valve structure of claim 1, wherein the foam discharging tube comprises a press section, and a pressure applying section linking with the press section to push the air supply valve.

13. The anti-leakage liquid soap valve structure of claim 1, wherein the foam discharging tube comprises a foaming filter disposed at the foam exit.

* * * * *